United States Patent [19]

Gann

[11] Patent Number: 4,689,006

[45] Date of Patent: Aug. 25, 1987

[54] SPARK IGNITION SYSTEM WITH POSITIVE SUPPRESSION OF SPARK WHEN PILOT FLAME IS SENSED

[75] Inventor: Ronald A. Gann, La Crescenta, Calif.

[73] Assignee: ITT Corporation, New York, N.Y.

[21] Appl. No.: 910,803

[22] Filed: Sep. 22, 1986

Related U.S. Application Data

[63] Continuation of Ser. No. 761,645, Aug. 2, 1985, abandoned.

[51] Int. Cl.[4] ..... F23N 5/10

[52] U.S. Cl. ..... 431/46; 431/74

[58] Field of Search ..... 43/42, 43, 46, 51, 60, 43/74, 12, 90

[56] References Cited

U.S. PATENT DOCUMENTS 3,986,813 10/1976 Hewit ..... 431/46

4,194,875 3/1980 Hewitt ..... 431/46

*Primary Examiner*—Samuel Scott

*Assistant Examiner*—Noah Kamen

*Attorney, Agent, or Firm*—Menotti J. Lombardi

[57] ABSTRACT

A spark ignition system for a pilot flame uses a flame sensing rod to switch ac voltage from a spark generator to a main valve, thereby providing positive suppression of spark generation once the pilot flame is sensed. A main oscillator activated by a flame sensing signal is provided to operate a switch for this purpose. Should the pilot flame be extinguished, the switch automatically reverts to its first state, thereby closing the main valve and reactivating the spark generator. The entire system is operative only when ac voltage is present from a thermostat demanding heat. The pilot valve connected directly to the thermostat is open to emit gas whenever there is a demand for heat.

1 Claim, 2 Drawing Figures

SPARK IGNITION SYSTEM WITH POSITIVE SUPPRESSION OF SPARK WHEN PILOT FLAME IS SENSED

This is a continuation of application Ser. No. 761,645 filed Aug. 2, 1985, now abandoned.

BACKGROUND OF THE INVENTION

This invention relates to spark ignition systems for gas burners, such as a heat furnace having a thermostat for ambient temperature control.

PRIOR ART STATEMENT

The prior art spark generators for ignition systems are similar in that a thyristor is connected in series with an ignition coil, and the series combination of the thyristor and coil is connected in parallel with a spark discharge capacitor. The energy to charge the capacitor comes from stepped-down line voltage or an oscillator. Typical of the prior art is the pilot ignition system shown in U.S. Pat. No. 4,124,354 to the present inventor and U.S. patent application Ser. No. 06/575,097. All of the aforementioned prior art circuits utilize the resistance of the flame to suppress the spark, but that technique requires a large flame for complete spark suppression. In some applications, the flame resistance cannot be relied upon to suppress the spark.

SUMMARY OF THE INVENTION

An object of this invention is to provide a system for positive suppression of the spark generator.

In accordance with the present invention, positive suppression of the spark generator for a pilot valve is provided, while a storage capacitor is continually charged, by control of an electronic switch in series with a resistor of an RC timing circuit for the spark generator comprised of a threshold trigger device, such as a diac, for firing a thyristor (SCR or other thyratron like device) in series with a storage capacitor and ignition coil. In particular a series combination of a capacitor, a resistor and a transistor functioning as a gated RC timing circuit is connected in parallel with the storage capacitor. The transistor is turned on when a thermostat calling for heat applies low bias voltage (24 V ac) to its control electrode through a relay switch and a rectifying diode. The transistor allows the capacitor in the RC timing circuit to charge sufficiently to trigger on a threshold device, which in turn allows a spark discharge of the storage capacitor. Once the pilot valve is ignited, a flame sensor gates an oscillator on to energize the relay switch, thereby to remove the bias voltage from the transistor in series with the RC circuit, thus inhibiting the triggering of the threshold device to suppress spark generation while the pilot flame is being sensed. When the relay switch is energized, it simultaneously opens the main gas valve. The pilot valve remains open and the spark generator is operative (unless a flame is sensed) while the thermostat is calling for heat.

The novel features that are considered characteristic of this invention are set forth with particularity in the appended claims. The invention will best be understood from the following description when read in connection with the accompanying drawings.

DESCRIPTION OF THE PREFERRED EMBODIMENTS

Figure 1:
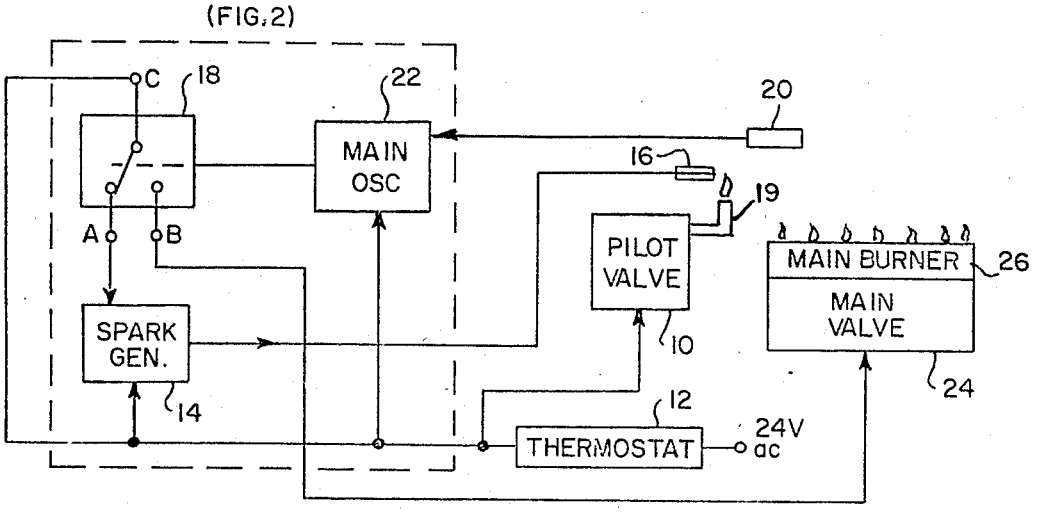
FIG. 1 is a functional block diagram of a pilot ignition system embodying the present invention.

Referring to FIG. 1, a pilot valve 10 is opened by low voltage (24 V) ac passed by a thermostat 12 when heat is required. This low voltage ac is also applied directly to a spark generator 14 to provide the necessary power to produce a spark at an electrode 16. The low voltage ac is also applied to the spark generator 14 through a single-pole, double-throw (SPDT) switch 18 to enable the spark generator 14 to produce sparks at a predetermined rate. Once a pilot burner 19 is lighted, a flame sensor 20 turns on a main oscillator 22, the output of which throws the switch 18 from contact A to B, thereby to divert the 24 V ac from the spark generator 14 to a main valve 24 for a main burner 26 of the furnace. Note that the switch 18 may be an electronic rather than an electromagnetic relay switch, in which case the main oscillator 22 may simply be comprised of a circuit means responsive to the flame sensor 20 for activating the switch 18. Once the switch 18 transfers from a contact A to a contact B, the spark generator 14 is positively suppressed.

With the pilot flame present, the main burner 26 is ignited, and the main valve 24 remains open as long as the thermostat 12 continues to call for heat. Once heat is no longer required from the furnace, a switch in the thermostat 12 opens to disconnect the 24 V ac from the relay switch 18, and therefor from the main valve 24, thus turning off the pilot burner 19 and main burner 26. The flame sensor 20 then deactivates the relay switch 18, via the activating means illustrated as a relay switch, thereby restoring a connection for the 24 V ac from the thermostat 12 to the spark generator 14 to enable it when the thermostat 12 again calls for heat and opens the pilot valve 10.

The circuit for the recycling pilot ignition system described with reference to blocks 14 and 22 in FIG. 1 will now be described with reference to FIG. 2 wherein the spark generator 14 is shown in the upper half and the main oscillator 22 is shown in the lower half of the circuit. The switch 18 is shown as an electromagnetic relay switch having a coil 28 and an armature 30 with a movable contact 32 connecting terminal C to terminal A when de-energized, and to terminal B when energized by the main oscillator 22 through a transformer $T_1$ and a diode $D_{1a}$.

The main oscillator 22 comprised of an NPN transistor $Q_1$ and a Darlington pair of PNP transistors $Q_2$, $Q_3$ is organized with emitter, collector and base bias resistors to operate in the same manner as in the aforesaid prior art U.S. Pat. No. 4,124,354. A signal from the flame sensor 20 activates the Darlington pair, which in turn activates the transistor $Q_1$. Feedback from a tap 34 in the primary winding of transformer $T_1$ through capacitor $C_1$ to the base of transistor $Q_3$ sustains oscillation as long as the signal from the flame sensor 20 is present to gate the oscillator 22 on through the Darlington pair of transistors $Q_2$, $Q_3$. The output of the oscillator 22 is coupled by the transformer $T_1$ and rectifying diode $D_{1a}$ to the coil 28 of the relay switch 18. A diode $D_{1b}$ shunts back EMF when the oscillator 22 is turned off and the relay switch 18 is de-energized. Power for the transistors is provided by rectifying diodes $D_2$ and $D_3$ and following RC filters $F_1$ and $F_2$ as shown. Bias for control of the Darlington pair is provided by a feedback capacitor $C_1$, and a capacitor $C_2$. Until a flame is sensed, the capacitor $C_3$ will not charge sufficiently negative to turn the transistor $Q_3$ on. When a flame is sensed, the flame sensor 20 forms a polarized resistance path to ground. That allows capacitor $C_3$ to charge with the polarity shown sufficiently to gate the oscillator 22 on as in the prior art referred to hereinbefore.

Figure 2:
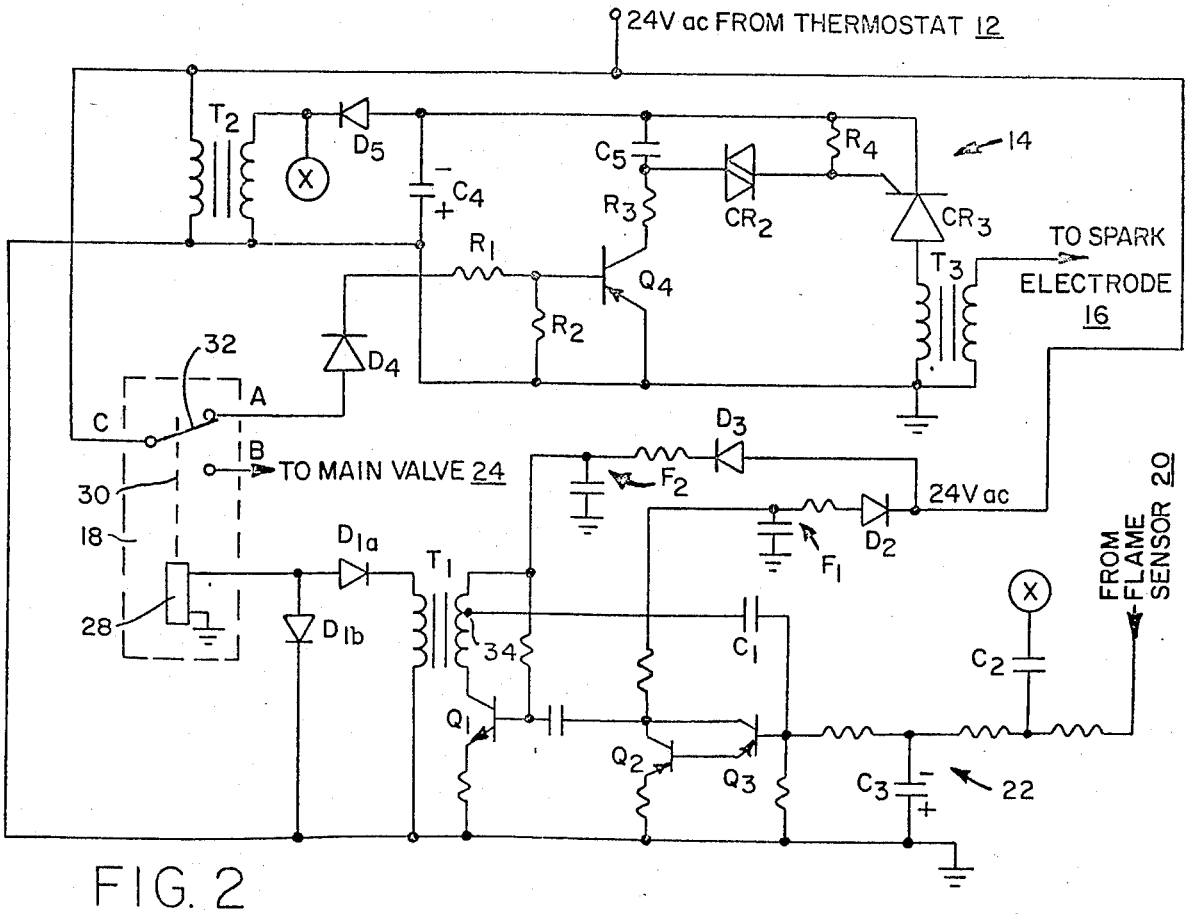
FIG. 2 is a circuit diagram of the spark generator and main oscillator shown in FIG. 1.

In the de-energized state, the movable end-contact 32 of the relay switch 18 is in the position shown in FIG. 2, thus connecting the 24 V ac from the thermostat 12 (which continually energizes the primary winding of the transformer $T_2$ while the thermostat 12 is calling for heat) to a diode $D_4$ which provides half-wave rectified current through a pair of resistors $R_1$ and $R_2$. The voltage drop across resistor $R_2$ provides a negative bias on the base of a PNP transistor $Q_4$ permitting it to conduct. An ac voltage is induced in the secondary winding of transformer $T_2$ and is half-wave rectified by a diode $D_5$. A capacitor $C_4$ stores electrical energy for the spark to be generated. A capacitor $C_5$, which is also connected to diode $D_5$, will not charge unless a transistor $Q_4$ is conducting. A threshold device $CR_3$ is open circuited and does not provide a path for capacitor $C_5$ to discharge. When transistor $Q_4$ is conducting, the capacitor $C_5$ charges and the voltage drop across resistor $R_3$ provides a biasing voltage for a device $CR_2$ to conduct when the capacitor $C_5$ charges sufficiently. Thus capacitor $C_5$ and resistor $R_3$ form an RC timing circuit for controlling the charge rate of capacitor $C_5$ which regulates the spark rate of a transformer $T_3$ in sparks per minute.

Device $CR_2$ is a bilateral trigger device (diac) which exhibits negative resistance when the applied voltage exceeds a threshold value for high conduction similar to a gas diode. Device $CR_2$ acts to produce a triggering signal to a gate electrode of a thyristor (silicon controlled rectifier) $CR_3$ when the thyristor is fired (triggered on) for connecting the storage capacitor $C_4$ in series with an ignition coil comprised of the primary winding of transformer $T_3$. When the voltage drop across resistor $R_3$ reaches 60 volts, device $CR_2$ becomes conductive and capacitor $C_5$ discharges through device $CR_2$ and the gate of the thyristor $CR_3$, permitting $CR_3$ to conduct. The substantial charge stored on capacitor $C_4$ is thus discharged through the thyristor $CR_3$and the primary winding of transformer $T_3$ which acts to step up the voltage discharge from capacitor $C_4$ to 16 kilovolts. The voltage pulses at the output of the transformer $T_3$ are fed to the spark electrode 16 which ignites the pilot burner 19. As noted above, the pilot valve 10 is connected to the low voltage (24 V ac) supply as long as the thermostat 12 is calling for heat. Once the pilot burner 19 is ignited, the flame sensor 20 senses the pilot flame to provide a negative charge on capacitor $C_3$ that turns on transistor $Q_3$, thereby gating on the main oscillator 22 which energizes the coil 28 in relay switch 18.

The energized coil 28 of relay switch 18 causes the movable contact 32 to switch to the alternate output contact position, B. Under these conditions, transformer $T_2$ remains energized, but current does not pass through diode $D_4$. Transistor $Q_4$, device $CR_2$ and thyristor $CR_3$ are nonconductive. Transformer $T_2$ charges capacitor $C_4$ through diode $D_5$ until very little current flows in the secondary winding of transformer $T_2$; the result of which is that the charge in the storage capacitor is immediately able to energize the spark generator. Thus, if a pilot flame is sensed, the main oscillator 22 is activated and spark generation is suppressed, but flame sensing terminates if the pilot flame is extinguished, such as when there is a momentary loss of gas supply. The main oscillator 22 is then automatically deactivated, and the coil 28 of relay switch 18 is de-energized. Relay switch 18 automatically returns the movable contact 32 to position A, thereby recycling the ignition system to the condition necessary to ignite the pilot burner 19, provided the thermostat 12 is still calling for heat; if not, the ignition system is shut down since all its power is through the thermostat 12.

When heat is again called for by the thermostat 12, the spark electrode 16 provides a spark to initiate another pilot flame which is sensed by the flame sensor 20. The latter once again gates the main oscillator 22 on, which in turn opens the main valve 24. Thus, whenever the main oscillator 22 is gated on, the coil 28 of relay switch 18 is energized. The main valve 24 is thus connected to the +24 V ac through position B of the relay switch 18. This opens the main valve 24 to provide gas to the main burner 26 which is ignited by the pilot burner 19. Note that the pilot valve 10 is connected directly to the thermostat 12 and must always be lighted when the thermostat 12 is calling for heat. Consequently, the only time that the pilot burner 26 is off is when the thermostat 12, which is in series with the 24 V ac supply, opens the voltage supply line to the pilot valve 10. The thermostat 12 will open the voltage supply line when the temperature of the space being heated is at the desired level.

Although particular embodiments of the invention have been described and illustrated herein, it is recognized that modifications and variations may readily occur to those skilled in the art. Consequently, it is intended that the claims be interpreted to cover such modifications and variations.

What is claimed is:

1. In a spark ignition system comprising an ac voltage source and a thermostat to call for heat by passing said ac voltage from said source, a main burner, a main valve responsive to ac voltage for admitting gas fuel to said main burner, a pilot burner, a pilot valve responsive to said ac voltage passed by said thermostat to admit gas fuel to said pilot burner, a flame sensor to detect a pilot flame, means responsive to said flame sensor for producing a signal when flame is being sensed, a gated spark generator energized by said voltage source passed by said thermostat, and an electrode adjacent said pilot burner connected to said spark generator to emit a spark;

a single-pole, double-throw switch having a first and a second contact, said switch normally making a connection with said first contact to energize said spark generator and alternately making a connection with said second contact to energize said main valve;

means for connecting said ac voltage from said thermostat directly to said pilot valve for admitting gas fuel and directly to said switch for applying said ac voltage to said spark gated generator through said first contact to cause said spark electrode to emit sparks while said thermostat is calling for heat, and thereby ignite the pilot gas fuel; and means responsive to said signal from said flame sensor for activating said single-pole, double-throw switch from connection of said ac voltage passed by said thermostat with said first contact to said second contact, thereby disabling said spark generator for positive suppression of spark when pilot flame is sensed, and applying ac voltage to said main valve for admitting gas to said main burner;

an improvement in said gated spark generator comprising a rectifier, a storage capacitor continually charged by said ac voltage from said thermostat through said rectifier, and a gated RC timing circuit comprised of a capacitor in series with a resistor for timing the generation of sparks and an electronic switch in series with said resistor and capacitor, said electronic switch having a control terminal connected to said first contact of said single-pole, double-throw switch, whereby said electronic switch is turned off for positive suppression of said spark generator when said pilot flame is sensed, and turned on when said pilot flame is not sensed for positive activation of said spark generator and wherein the change in storage capacitor is immediately able to energize said spark generator.

* * * * *